US007857488B2

(12) United States Patent
Chen et al.

(10) Patent No.: US 7,857,488 B2
(45) Date of Patent: Dec. 28, 2010

(54) LED LAMP

(75) Inventors: Chin-Chung Chen, Taipen Hsien (TW); Hai-Wei Zhang, Shenzhen (TW)

(73) Assignees: Fu Zhun Precision Industry (Shen Zhen) Co., Ltd., Shenzhen, Guangdong Province (CN); Foxconn Technology Co., Ltd., Tucheng, Taipei County (TW)

( * ) Notice: Subject to any disclaimer, the term of this patent is extended or adjusted under 35 U.S.C. 154(b) by 124 days.

(21) Appl. No.: 12/328,779

(22) Filed: Dec. 5, 2008

(65) Prior Publication Data

US 2010/0097797 A1 Apr. 22, 2010

(30) Foreign Application Priority Data

Oct. 17, 2008 (CN) ..... 2008 1 0304982

(51) Int. Cl.
*F21V 7/00* (2006.01)

(52) U.S. Cl. ..... 362/297; 362/346; 362/97.3

(58) Field of Classification Search ..... 362/244, 362/264, 294, 373, 341, 345, 297, 217.05, 362/217.06, 217.07, 249.02, 249.01, 237, 362/235, 97.3, 346, 240, 311.06, 311.08, 362/296.05, 296.06, 347
See application file for complete search history.

(56) References Cited

U.S. PATENT DOCUMENTS

| | | | | |
|---|---|---|---|---|
| 6,575,613 | B2 * | 6/2003 | Brown et al. | 362/565 |
| 2004/0218388 | A1 * | 11/2004 | Suzuki | 362/231 |
| 2006/0007013 | A1 * | 1/2006 | Singer et al. | 340/815.45 |
| 2007/0115656 | A1 * | 5/2007 | Chou et al. | 362/228 |

* cited by examiner

*Primary Examiner*—Jong-Suk (James) Lee
*Assistant Examiner*—Julie A Shallenberger
(74) *Attorney, Agent, or Firm*—Frank R. Niranjan

(57) ABSTRACT

An LED lamp includes a printed circuit board, a plurality of LED modules mounted on the printed circuit board and a reflector mounted on the printed circuit board and covering the LED modules. The reflector includes a first extending portion and a second extending portion extending from a side of the first extending portion. Top surfaces of the first and second extending portions are slantwise and oriented towards different directions, thereby to cooperatively form a V-shaped configuration. The LED modules are received in receiving holes in the first and second extending portions. Each receiving hole has a cross section gradually enlarged along a bottom-to-top direction.

18 Claims, 5 Drawing Sheets

LED LAMP

BACKGROUND OF THE INVENTION

1. Field of the Invention

The disclosure relates to an LED lamp, and more particularly to an LED lamp having a wide illumination.

2. Description of Related Art

The technology of light emitting diodes has rapidly developed in recent years from indicators to illumination applications. With the features of long-term reliability, environment friendliness and low power consumption, the LED is viewed as a promising alternative for future lighting products.

A conventional LED lamp comprises a heat sink and a plurality of LED modules having LEDs attached to an outer surface of the heat sink to dissipate heat generated by the LEDs. The outer surface of the heat sink generally is planar and the LEDs are arranged close to each other. When the LED lamp works, the LEDs mounted on the planar outer surface of the heat sink only form a planar light source.

What is needed, therefore, is an LED lamp having a wide illumination to thereby function as a three-dimensional light source.

Other advantages and novel features will become more apparent from the following detailed description of preferred embodiments when taken in conjunction with the accompanying drawings, in which:

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION OF THE INVENTION

Figure 1:
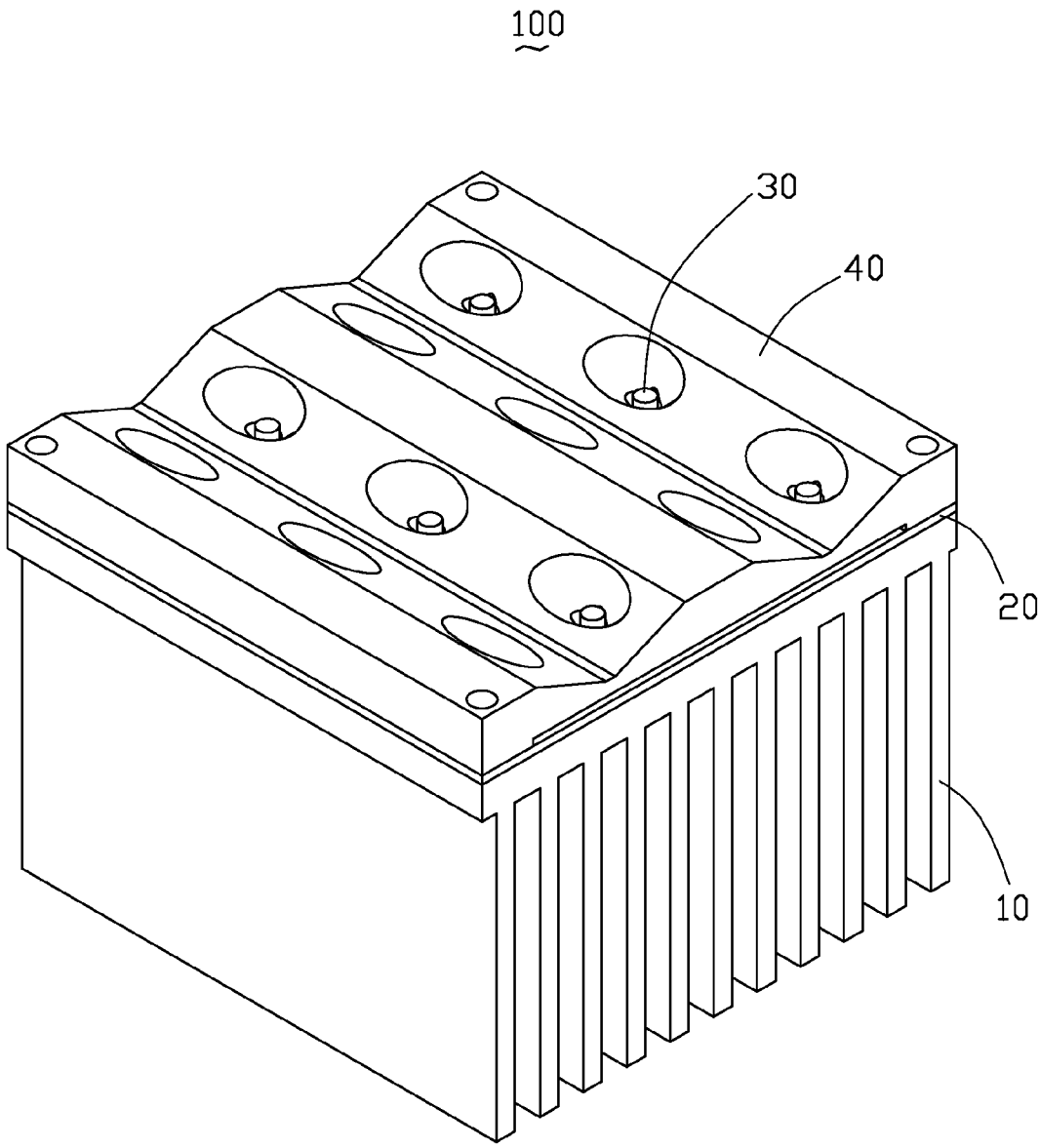
FIG. 1 is an assembled view of an LED lamp in accordance with an embodiment of the disclosure.
Figure 2:
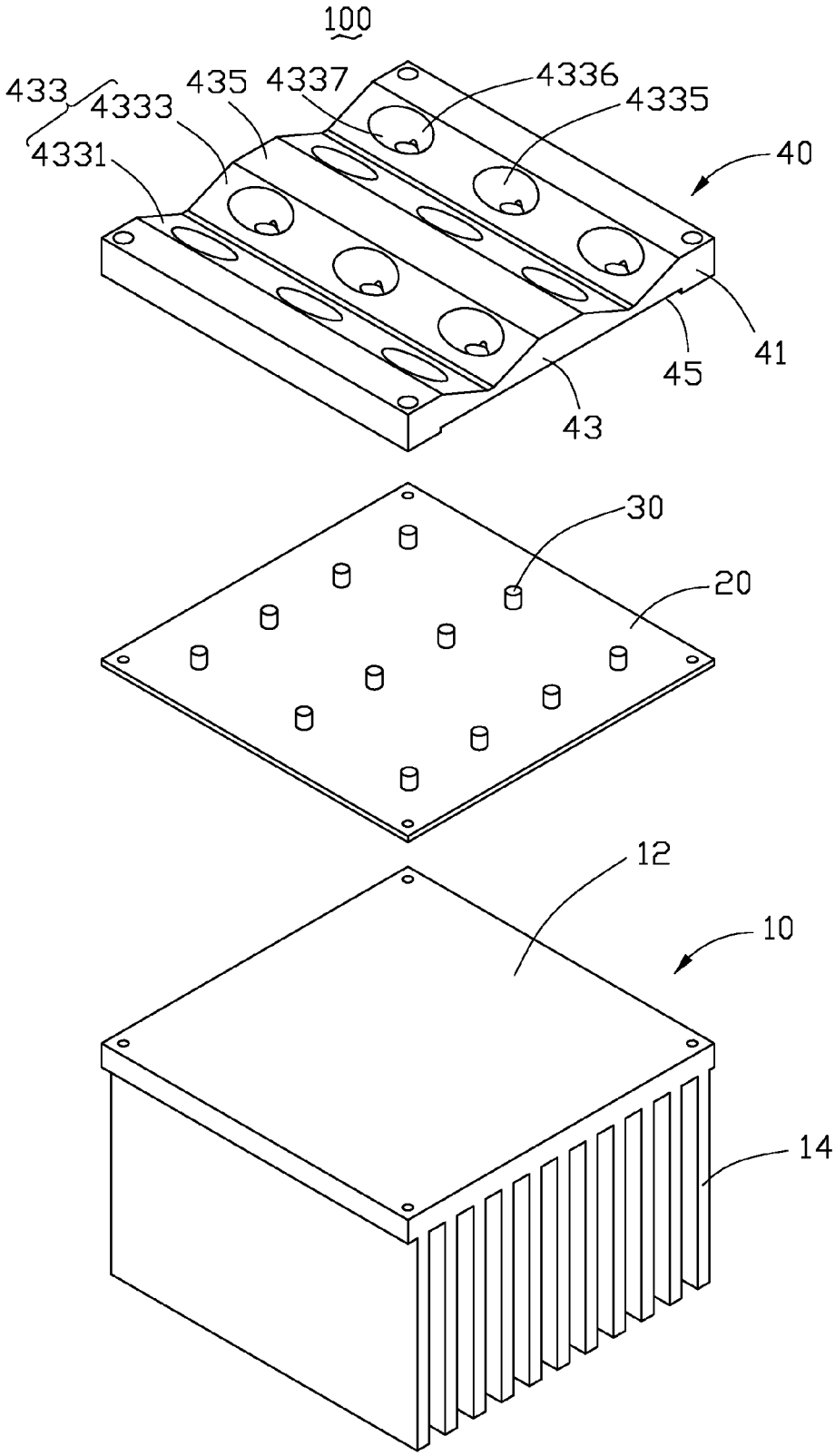
FIG. 2 is an exploded view of FIG. 1.

Referring to FIGS. 1-2, an LED lamp 100 comprises a heat sink 10, a printed circuit board 20 mounted on a side of the heat sink 10, a plurality of LED modules 30 mounted on the printed circuit board 20, and a reflector 40 mounted on the printed circuit board 20 and covering the LED modules 30.

The heat sink 10 is made of a material with a high degree of heat conductivity, such as copper or aluminum. The heat sink 10 comprises a square base 12. A plurality of fins 14 extend downwardly from a bottom surface of the base 12.

Figure 3:
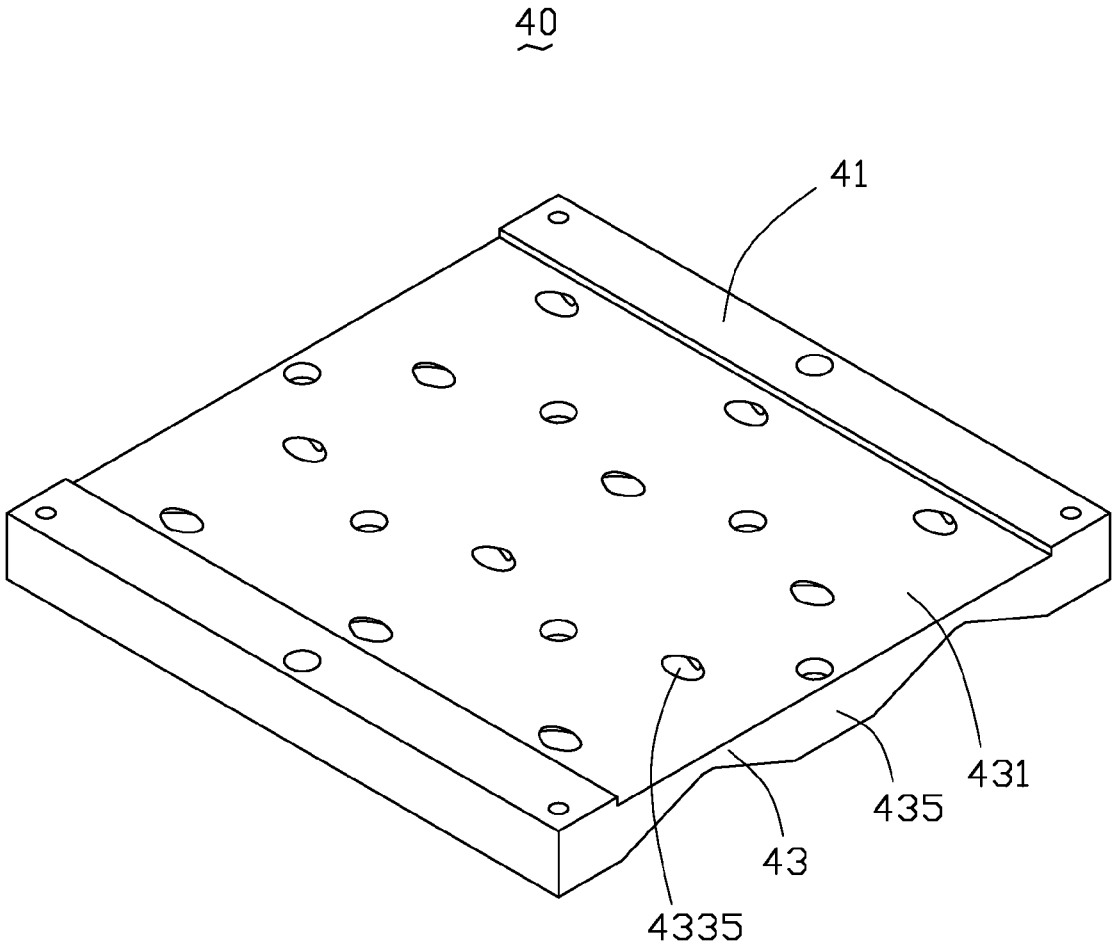
FIG. 3 is an inverted view of a reflector of FIG. 2.

Referring to FIG. 3 also, the reflector 40 is integrally formed by plastic. The reflector 40 comprises two elongated mounting members 41 and a covering member 43 between the mounting members 41. A top surface of the covering member 43 is waved and used to reflect light emitted from the LED modules 30. Bottom surfaces of the mounting members 41 are planar and coplanar with each other. A bottom surface of the covering member 43 is planar and located above the bottom surfaces of the mounting member 41. Therefore, the mounting members 41 and the covering member 43 cooperatively define an inverted U-shaped recess 45 in a bottom of the reflector 40.

The covering member 43 comprises two V-shaped reflecting portions 433 and a connecting portion 435. The connecting portion 435 is elongated and located between the reflecting portions 433 to connect the reflecting portions 433 together. The reflecting portions 433 are symmetrical about a central surface of the connecting portion 435, which is longitudinally extended through the connecting portion 435. Each reflecting portion 433 comprises a first extending portion 4331 extending slantwise from an inside edge of the corresponding mounting member 41 and a second extending portion 4333 extending slantwise from an edge of the connecting portion 435. The second extending portion 4333 is oriented towards the first extending portion 4331. Height of the first extending portion 4331 is decreased along a direction from a left to right. Height of the second extending portion 4333 is decreased along a direction from a right to left. Bottom ends of the first and second extending portions 4331, 4333 connect with each other to form the V-shaped configuration. Each of the first and second extending portions 4331, 4333 defines three funnel-like receiving holes 4335 to receive three LED modules 30 therein, respectively. Each receiving hole 4335 extends through the covering member 43 from the top surface to the bottom surface of the covering member 43. The receiving holes 4335 are spaced from each other. The receiving hole 4335 has a top opening larger than a bottom opening thereof. The top and bottom openings of the receiving holes 4335 each have an oval configuration, with a width thereof along a transverse direction of the reflector 40 being larger than that along a longitudinal direction. A cross section of the receiving hole 4335 is gradually increased along a direction from the bottom to the top. Each receiving hole 4335 is surrounded by a first sidewall 4336 and a second sidewall 4337. The first and second sidewalls 4336, 4337 are oriented towards each other along the transverse direction. The first sidewall 4336 is located at a thick side of the first or second extending portions 4331, 4333 and has a height larger than that of the second sidewall 4337. The second sidewall 4337 is oriented towards the first sidewall 4336. The first and the second sidewall 4336, 4337 are slantwise.

In assembly, the printed circuit board 20 is mounted on a top surface of the base 12 of the heat sink 10. The mounting members 41 of the reflector 40 press opposite ends of the printed circuit board 10 and are mounted on the printed circuit board 10. When a size of the printed circuit board 10 is small, the printed circuit board 10 can be received in the recess 45 of the reflector 40. The LED modules 30 extend upwardly through the recess 45 and the bottom surface of the covering member 43 to be received in the receiving holes 4335 of the reflecting portions 433 of the covering member 43.

In use, light emitted from the LED modules 30 is reflected by the first and second sidewalls 4336, 4337 of the receiving holes 4335 and then is reflected by the top surfaces of the reflecting portions 433 of the reflecting member 43 of the reflector 40. Because the opposite first and second sidewalls 4336, 4337 of the receiving holes 4335 face each other along the transverse direction of the reflector 40 and are slantwise to the top surfaces of the first and second extending portions 4331, 4333, light emitted from the LED modules 30 can radiate with a large angle over a large area.

Figure 4:
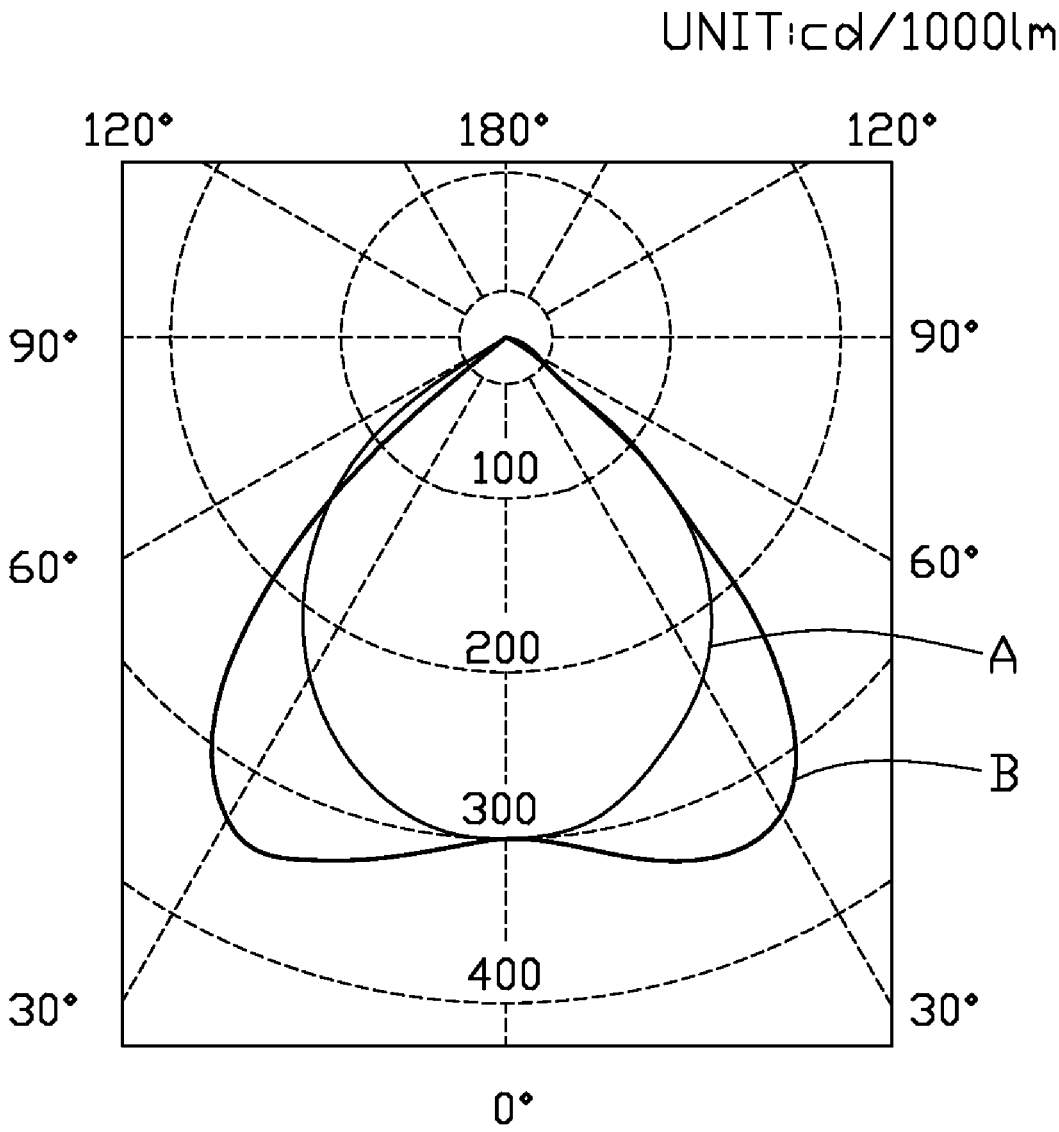
FIG. 4 is a luminous intensity curve graph of a conventional fluorescent lamp.
Figure 5:
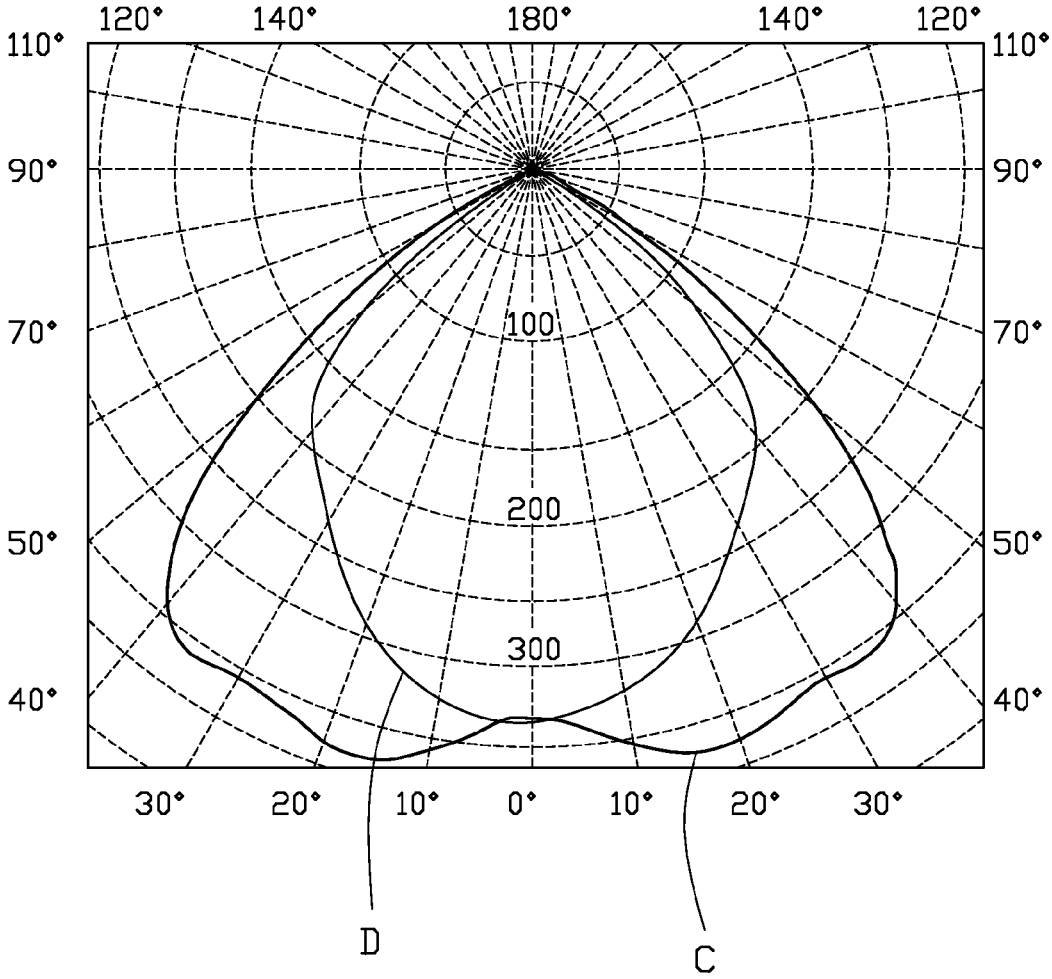
FIG. 5 is a luminous intensity curve graph of the LED lamp of the present invention.

FIG. 4 shows a luminous intensity curve of a conventional fluorescent lamp having a power of 36 watts. Referring to FIG. 4, a curve A shows a luminous intensity curve of the conventional fluorescent lamp along a first direction (i.e. a transverse direction of the conventional fluorescent lamp), and a curve B shows a luminous intensity curve of the conventional fluorescent lamp along a second direction perpendicular to the first direction. FIG. 5 shows a luminous intensity curve of the LED lamp 100 having a power of 12 watts. Referring to FIG. 5, a curve C shows a luminous intensity curve of the LED lamp 100 along a third direction (i.e., a transverse direction of the LED lamp 100), and a curve D shows a luminous intensity curve along a fourth direction perpendicular to the third direction. The luminous intensity of the LED lamp 100 is larger than that of the conventional fluorescent lamp at any direction while the consumed power of the LED lamp 100 is less than that of the conventional fluorescent lamp. The LED lamp 100 meets the luminous intensity and saves energy at the same time. Furthermore, the LED lamp 100 in accordance with the present disclosure has a more even distribution of the light intensity and a larger angle of illumination, whereby the level of unfavorable glare can be lowered and a more comfortable lightening is obtained. Finally, the LED lamp 100 in accordance with the present invention can have a light output efficiency of more than 95%.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An LED lamp comprising:

a printed circuit board;

a plurality of LED modules mounted on the printed circuit board; and a reflector mounted on the printed circuit board and surrounding the LED modules, the reflector comprising a first extending portion and a second extending portion extending from a side of the first extending portion, each of the first and second extending portions comprising a top surface, the top surfaces of the first and second extending portions being slantwise and oriented towards different directions, the LED modules being received in the first and second extending portions;

wherein the reflector further comprises a pair of mounting members sandwiching the first and second extending portions therebetween and a third extending portion extending from a side of the second extending portion and a fourth extending portion extending from a side of the third extending portion, top surfaces of the third and fourth extending portion forming an V-shaped configuration, the LED modules being also received in the third and fourth extending portions.

2. The LED lamp as claimed in claim 1, wherein the top surfaces of the first and second extending portions are oriented toward each other to form a V-shaped configuration.

3. The LED lamp as claimed in claim 2, wherein bottom surfaces of the first and second extending portions are coplanar.

4. The LED lamp as claimed in claim 1, wherein the first and second extending portions defines a plurality of receiving holes therein to receive the LED modules of the LED lamp.

5. The LED lamp as claimed in claim 4, wherein each of the receiving holes has a top opening and a bottom opening communicating with the top opening, the top and bottom openings of the receiving hole each having an oval shape with a small width in a transverse direction of the reflector and a larger width in a longitudinal direction thereof

6. The LED lamp as claimed in claim 4, wherein a cross section of each receiving hole is gradually increased along a direction from bottom to top.

7. The LED lamp as claimed in claim 4, wherein each of the receiving holes comprises a first side wall portion and a second side wall portion oriented towards the first side wall portion, and a height of the first side wall portion is larger than that of the second side wall portion.

8. The LED lamp as claimed in claim 2, wherein a connecting portion is sandwiched between the second and third extending portion to connect the second and third extending portions.

9. The LED lamp as claimed in claim 8, wherein the V-shaped configuration formed by the first and second extending portions and the another V-shaped configuration formed by the third and fourth extending portions are symmetrical about a central surface of the connecting portion.

10. An LED lamp comprising:

a printed circuit board;

a plurality of LED modules mounted on the printed circuit board; and a reflector mounted on the printed circuit board and surrounding the LED modules, the reflector comprising a first extending portion and a second extending portion extending from a side of the first extending portion, each of the first and second extending portions comprising a top surface and a bottom surface, and defining a plurality of through receiving holes running through the top surface and the bottom surface, each of the receiving holes comprising a first side wall portion and a second side wall portion located at an opposite side of the first side wall portion and oriented towards the first side wall portion, the first and second side wall portions of each of the receiving holes being slantwise and oriented towards opposite directions, the LED modules being received in the receiving holes, a length of the first side wall portion from the bottom surface to the top surface is larger than that of the second side wall portion.

11. The LED lamp as claimed in claim 10, wherein each of the receiving holes has a top opening and a bottom opening communicating with the top opening, the top and bottom openings each having an oval shape with a width in a transverse direction of the reflector being smaller than that in a longitudinal direction.

12. The LED lamp as claimed in claim 10, wherein a cross section of each receiving hole is gradually increased along a direction from bottom to top.

13. The LED lamp as claimed in claim 10, wherein the top surfaces of the first and second extending portions are oriented toward each other to form a V-shaped configuration.

14. The LED lamp as claimed in claim 10 further comprising a heat sink on which the printed circuit board is mounted.

15. An LED lamp comprising:

a heat sink having a top surface and a bottom surface, a plurality of fins extending downwardly from the bottom surface;

a printed circuit board mounted on the top surface of the heat sink;

a plurality of LED modules mounted the printed circuit board; and a reflector mounted on the printed circuit board and surrounding the LED modules, wherein the reflector has at least two interconnected extending portions having top surfaces thereof cooperatively forming a V-shaped configuration, and bottom surfaces of the at least two interconnected extending portions being coplanar, a plurality of receiving holes extending through the at least two interconnected extending portions along a bottom-to-top direction thereof, the LED modules being received in the receiving holes, respectively, each receiving hole having a small bottom opening and a large top opening.

16. The LED lamp as claimed in claim 15, wherein each of the top and bottom openings has an oval shape.

17. The LED lamp as claimed in claim 16, where a cross section of each receiving hole is gradually increased along the bottom-to-top direction.

18. The LED lamp as claimed in claim 10, wherein the bottom surfaces of the first and second extending portions are coplanar.

* * * * *